US008245714B2

(12) United States Patent
Malvar et al.

(10) Patent No.: US 8,245,714 B2
(45) Date of Patent: Aug. 21, 2012

(54) COSMETIC MATERIAL APPLICATOR, DISPENSER INCLUDING THE SAME, AND ACTUATOR THEREFOR

(75) Inventors: Michael Malvar, Oceanside, NY (US); Volker Schrepf, East Islip, NY (US)

(73) Assignee: Albea Services, Genevilliers (FR)

( * ) Notice: Subject to any disclaimer, the term of this patent is extended or adjusted under 35 U.S.C. 154(b) by 1268 days.

(21) Appl. No.: 11/825,337

(22) Filed: Jul. 6, 2007

(65) Prior Publication Data

US 2008/0011316 A1 Jan. 17, 2008

Related U.S. Application Data

(60) Provisional application No. 60/831,167, filed on Jul. 13, 2006.

(51) Int. Cl.
*A45D 24/10* (2006.01)

(52) U.S. Cl. ..... 132/118

(58) Field of Classification Search ..... 132/318, 132/320, 216, 217, 218, 119.1; 401/195, 401/129, 126, 122, 118, 121, 127, 128, 130; 15/22.2

See application file for complete search history.

(56) References Cited

U.S. PATENT DOCUMENTS

| | | | | |
|---|---|---|---|---|
| 3,270,360 | A * | 9/1966 | Kropp | 15/22.1 |
| 3,661,018 | A * | 5/1972 | Keefer et al. | 74/22 R |
| 6,799,582 | B2 * | 10/2004 | Kim | 132/317 |
| 6,997,889 | B1 * | 2/2006 | Thomas | 601/137 |
| 7,481,592 | B2 * | 1/2009 | Gueret | 401/129 |
| 2006/0032512 | A1 | 2/2006 | Kress et al. | |
| 2006/0272667 | A1 * | 12/2006 | Wyatt et al. | 132/218 |

FOREIGN PATENT DOCUMENTS

WO WO 2006/090343 A1 8/2006

* cited by examiner

*Primary Examiner* — Todd Manahan
*Assistant Examiner* — Brianne Kalach
(74) *Attorney, Agent, or Firm* — Cooper & Dunham LLP

(57) ABSTRACT

An applicator for cosmetic material such as mascara, including an applicator head for transporting and applying the cosmetic material, a handle, a stem bearing the applicator head and received in and guided by the handle so as to be longitudinally reciprocable relative thereto, and actuating mechanism carried by the handle for moving the stem longitudinally back and forth relative to the handle.

8 Claims, 14 Drawing Sheets

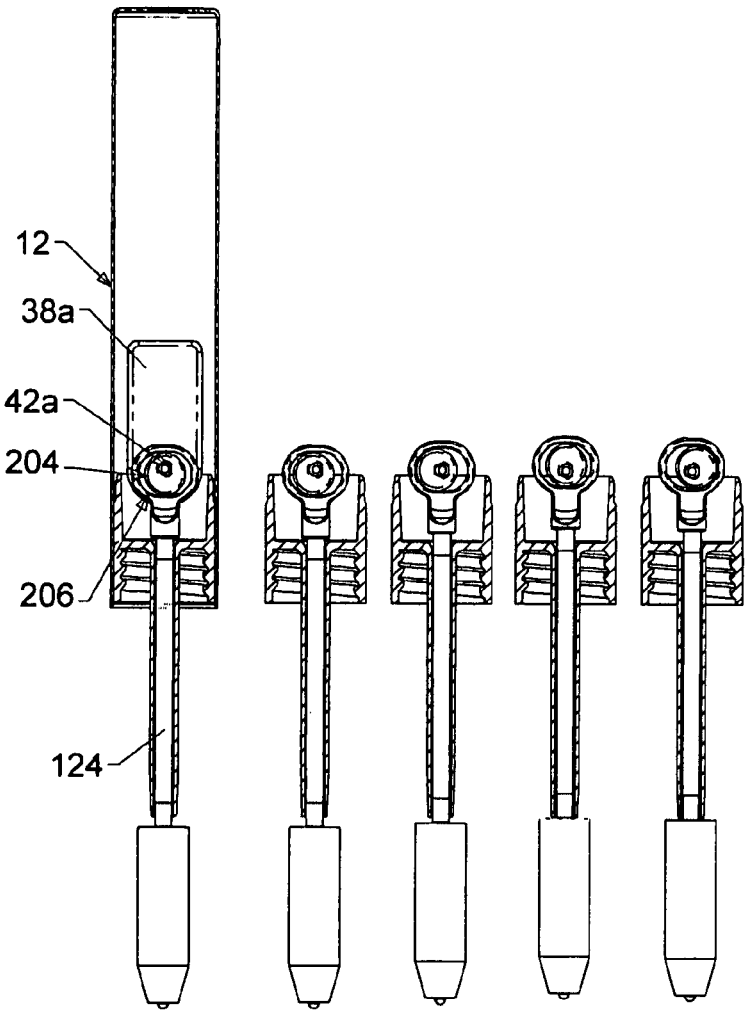
FIG. 35
FIG. 35A
FIG. 35B
FIG. 35C
FIG. 35D
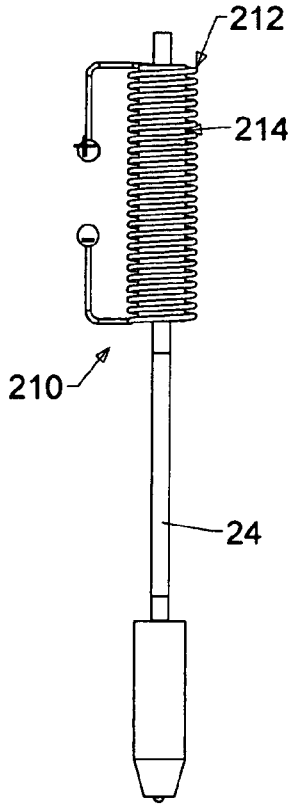
FIG. 36

COSMETIC MATERIAL APPLICATOR, DISPENSER INCLUDING THE SAME, AND ACTUATOR THEREFOR

CROSS REFERENCE TO RELATED APPLICATION

This application claims the benefit under 35 U.S.C. 119(e) of provisional application No. 60/831,167 filed Jul. 13, 2006, the entire disclosure of which is incorporated herein by this reference.

BACKGROUND OF THE INVENTION

This invention relates to cosmetic material applicators having an actuating mechanism for imparting limited reciprocatory motion to an applicator head, as well as to cosmetic material dispensers including such applicators, and to actuating mechanisms useful therein.

One particularly important field of use of the invention, to which detailed reference will be made herein for purposes of illustration, is the application of mascara to a user's eyelashes.

A typical present-day mascara dispenser is a small, hand-held object of cylindrical or other elongated shape, suitable to be carried in a user's purse or pocket. It includes an open-necked container for holding a quantity of mascara, a manually graspable cap for closing the container neck, and a mascara brush or like applicator head mounted at the free end of a stem that projects from the interior of the cap so that the brush is inserted into the contained mascara when the cap is seated on the neck. The brush is commonly an axially elongated array of free-ended fibers or bristles which are clamped centrally in, and radiate outwardly from, a twisted wire core, such brushes being referred to as twisted-in-wire brushes. The cap, stem and brush together constitute an applicator for transporting mascara from the container to the eyelashes and applying the mascara on the lashes, with the cap serving as a handle for manipulation of the brush by the user.

As will be understood, the brush picks up mascara from the container while immersed therein, and conveys it to the eyelashes upon withdrawal of the brush from the container, with excess mascara being removed from the brush by a wiper element in the container neck. Holding the cap, the user strokes the lashes with the mascara-laden brush to deposit and distribute mascara on the lashes. Thereafter, the cap and brush are returned to the container to pick up more mascara or to reclose the container.

To achieve full and uniform coating of the lashes, it has heretofore been proposed that the brush should be manipulated so as to stroke the lashes along their length from base to tip, while imparting to the brush a back-and-forth movement across the lashes. This combination of motions, however, is manipulatively difficult to perform with a conventional mascara applicator.

SUMMARY OF THE INVENTION

The present invention in a first aspect broadly contemplates the provision of an applicator for cosmetic material, comprising an applicator head for transporting a quantity of a cosmetic material and applying it to an end use location; a stem having a long axis, a distal portion bearing at least a portion of the applicator head, and a proximal portion; a manually graspable handle connected to the proximal portion of the stem so as to permit limited reciprocatory movement of the stem along the stem long axis, relative to the handle, the distal portion of the stem projecting from the handle; and actuating mechanism, carried by the handle, for imparting such reciprocatory movement to the stem relative to the handle.

More particularly, the stem is received in the handle for guided sliding movement of the stem, relative to the handle, back and forth along the stem long axis. The handle may include or have fixedly connected thereto a guide that is slidably engageable by the stem to limit the movement of the stem (relative to the handle) to directions along the long axis of the stem. This guide may be, for example, an open-ended guide sheath through which the stem slidably extends with the applicator head disposed distally of the guide sheath. Alternatively, the guide may be a hollow portion of the handle structure laterally surrounding and slidably engaged by an enlarged proximal portion of the stem such that the stem is movable, relative to the handle, only in directions along the stem long axis.

The actuating mechanism may include a drive disposed within the handle and having a rotary output shaft, a cam member rotated by the output shaft and a nonrotatable cam follower connected to the stem at a proximal location thereof and slidably engaging the cam member, with the cam member and cam follower being mutually configured to convert rotary motion of the output shaft to reciprocatory movement of the stem along the axis. In particular embodiments of the invention, wherein the output shaft and the stem are coaxial, the cam member and follower slidingly engage at a locus of contact that undulates (moves smoothly back and forth) along the stem long axis as the cam member rotates, reciprocating the follower and the stem connected thereto in correspondence with the undulations of the locus of contact. The cam member may be circular in plan projection on a plane perpendicular to the axis, with a continuous periphery that undulates axially as it rotates (e.g., is formed with alternating undulations respectively extending in opposite directions along the axis, or is tilted with respect to the axis of rotation), while the cam follower slidingly receives and engages a small angular extent of the cam member periphery such that, as the cam member rotates with the shaft, the cam follower and the stem are moved back and forth along the axis in correspondence with the undulatory motion of the cam member periphery engaged by the cam follower. Again, one of the cam member and cam follower may have a cylindrical surface formed with an undulating endless groove and the other of the cam member and follower may have a projection that rides in the groove so as to move the follower, and the attached stem, back and forth.

In further embodiments of the invention, the drive may have an output rotor that rotates about an axis transverse to the stem long axis, and a periphery of or point on the rotor eccentric to the rotor axis of rotation may be connected to the proximal portion of the stem within the handle by a sliding mechanism or double-pivoted linkage whereby rotation of the rotor moves the stem back and forth along the stem long axis.

The drive may be powered either manually or automatically. For example, the drive may be a motor disposed within the handle, such as a battery powered motor controlled by a switch on the handle. As another example, the drive may be a manually windable torsion spring disposed within the handle.

In still other embodiments of the invention, the drive may be a solenoid mounted within the handle and having a plunger that reciprocates along the stem long axis and is connected to the proximal end of the stem, for directly pushing and pulling the stem back and forth.

An alternative type of actuating mechanism for the applicators of the invention comprises an inertial drive mounted within the handle and including a weight suspended between first and second helical springs and connected to the stem proximally of the sheath, with the first helical spring, the weight, and the second helical spring being disposed in tandem along the aforesaid axis, such that upon displacement of the weight in an axial direction, the weight moves back and forth, imparting to the stem reciprocatory movement along the axis.

One important environment of use of the invention is the application of mascara, wherein the aforementioned end use location to which the cosmetic material (mascara) is applied is the user's eyelashes. To this end, the applicator head may be a mascara brush secured to the stem distal portion and the handle may be a cap removably mounted (e.g., threaded, snap-fitted or press-fitted) on an opening of a mascara container for closing the opening with the distal portion of the stem projecting through the opening into the interior of the container. Thus, the brush may be a twisted-in-wire mascara brush secured to and coaxial with the stem distal portion and the cap may be mountable on a neck of a mascara container for closing the container with the distal portion of the stem and the brush projecting through the neck into the container.

Another type of applicator head that can be used in embodiments of the invention comprises a flexible helical member coaxially surrounding the stem and having a proximal end and a distal end respectively secured to the sheath and engaging the distal portion of the stem distally of the sheath such that the helical member expands and contracts along the aforesaid axis as the stem undergoes reciprocatory motion relative to the handle.

When the drive is a motor or solenoid, the switch that turns it on and off may be manual or (if the handle is a cap for a cosmetic container) may close and open automatically as the cap is removed from and returned to the container.

In a second aspect, the invention embraces a mascara dispenser comprising an applicator as described above and a container of mascara having a neck engageable with the cap.

In a further aspect, the invention contemplates the provision, in an actuating mechanism for imparting reciprocatory movement along an axis to an element movable along the axis, in combination with a driving element rotating about the axis, of an assembly for converting rotary motion of the driving element to reciprocatory movement of the movable element along the axis, the assembly comprising a cam member rotated by the driving element about the axis and a cam follower connected to the movable element and engaging the cam member, the cam member and cam follower being mutually configured to convert rotary motion of the cam member to reciprocatory movement of the movable element along the axis, wherein the cam member and follower slidingly engage at a locus of contact that undulates (moves smoothly back and forth) along the stem long axis as the cam member rotates, reciprocating the follower and the stem connected thereto in correspondence with the undulations of the locus of contact.

Stated with reference to the use of the applicator (including the actuating mechanism) and dispenser of the invention to dispense and apply mascara to a user's eyelashes, the applicator head or brush is driven in limited reciprocatory or oscillatory motion along its axis, independently of the user's manipulation of the handle or cap to stroke the lashes with the brush, as mascara is applied to the lashes. That is to say, while the user is manipulating the brush in strokes directed along the lashes (with the axis of the brush oriented transversely of the lashes), the brush is simultaneously being reciprocated by the actuating mechanism along its axis so as to undergo back-and-forth movement across the lashes. This back-and-forth movement, provided by a mechanism wholly contained within a normal-sized mascara dispenser cap, affords desirably effective application and distribution of mascara on the lashes in a simple, easy and convenient way, without requiring unusual or complex manipulation of the brush.

The provision of such a secondary mode of motion, in a manipulable applicator or the like, affords benefits in other environments of use as well.

Further features and advantages of the invention will be apparent from the detailed description hereinafter set forth, together with the accompanying drawings.

BRIEF DESCRIPTION OF THE DRAWINGS

FIGS. 35 and 35A-35D are simplified schematic longitudinal sectional views of yet another embodiment of the invention;

FIG. 36 is a simplified schematic longitudinal sectional view of yet another embodiment of the invention;

DETAILED DESCRIPTION

Figure 1A:
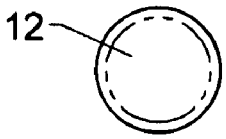
FIG. 1A is an end view of the dispenser of FIG. 1.
Figure 1:
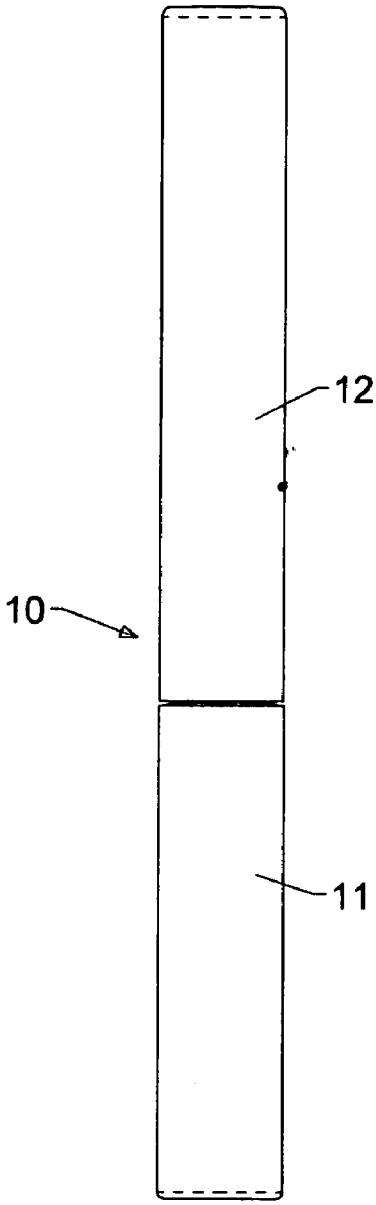
FIG. 1 is a side view of a mascara dispenser embodying the present invention in a particular form.

The invention will initially be described, with reference to FIGS. 1-17, as embodied in a mascara dispenser 10 including an open-necked container 11 for holding a quantity of mascara and an applicator 12 for conveying mascara from the container for deposit on a user's eyelashes.

As in conventional mascara dispensers, the container 11 is a hollow cylindrical molded plastic element having a closed lower end 14 and an open upper end or neck 16 of reduced diameter formed with an external thread 18. The applicator 12 includes a cylindrical rigid cap 20, open at its lower end 21 for seating on the neck 16 to close the container, and having an internal thread 22 for engaging the neck thread 18 to secure the cap to the neck. An elongated, axially rectilinear stem 24 extends from the interior of the cap, coaxially therewith, through and for a substantial distance beyond the open end 21 of the cap so as to project into the interior of the container when the cap is seated on the neck 16; the stem has a proximal end that is disposed in and connected to the cap, and a free distal end bearing, as an applicator head, a generally conventional twisted-in-wire mascara brush 28. This brush, typically about one inch in axial length, is constituted of a multiplicity of free-ended bristles 30, e.g., nylon fibers, gripped centrally by an axially rectilinear twisted wire core 32 mounted in the distal end of the stem and projecting distally therefrom along the long axis of the stem. It will be understood that the terms "proximal" and "distal" as used herein refer to directions respectively toward and away from the cap 20 along the long axis of the stem 24.

The arrangement of the cap, stem and brush is such that in the closed dispenser, the brush is immersed in the contained mascara. Upon separation of the cap from the container the brush is withdrawn through the neck, bearing mascara on its fibers, while excess mascara is removed from the brush by a molded flexible plastic tubular wiper element 34 mounted within the neck. The user, grasping the cap manually, then employs it as a handle to apply mascara from the brush onto the eyelashes. Thereafter the cap and brush are returned to the container, to pick up additional mascara for application to the lashes or to reclose the container.

In accordance with the present invention, and in contrast to the structure of conventional mascara applicators, the stem 24 is not fixedly secured at its proximal end to the cap or handle 20 but is instead connected to the cap in such manner as to be capable of back-and-forth (reciprocatory) movement along its long axis relative to the cap, viz., in the directions represented by double-headed arrow 35, while being retained against separation from the cap. Further, an actuating mechanism 36 is provided within the cap for imparting such reciprocatory movement to the stem, e.g., at the same time that the user is manipulating the brush to stroke the eyelashes in a direction transverse to the stem axis. Specifically, in the embodiment of FIGS. 1-17, the actuating mechanism includes an electric motor 38 powered by a battery 40 and having a rotary output shaft 42; a cam member 44 engaged by the shaft 42 so as to rotate therewith; and a cam follower 46 fixed to (and formed integrally with) the proximal end of the stem 24 and slidably engaging the cam member 44. The cam member and cam follower are mutually configured so that as the cam member rotates, the stem 24 attached to the cam follower moves back and forth over a limited distance (undergoes limited reciprocatory movement) along its long axis, as hereinafter further explained.

Figure 13A:
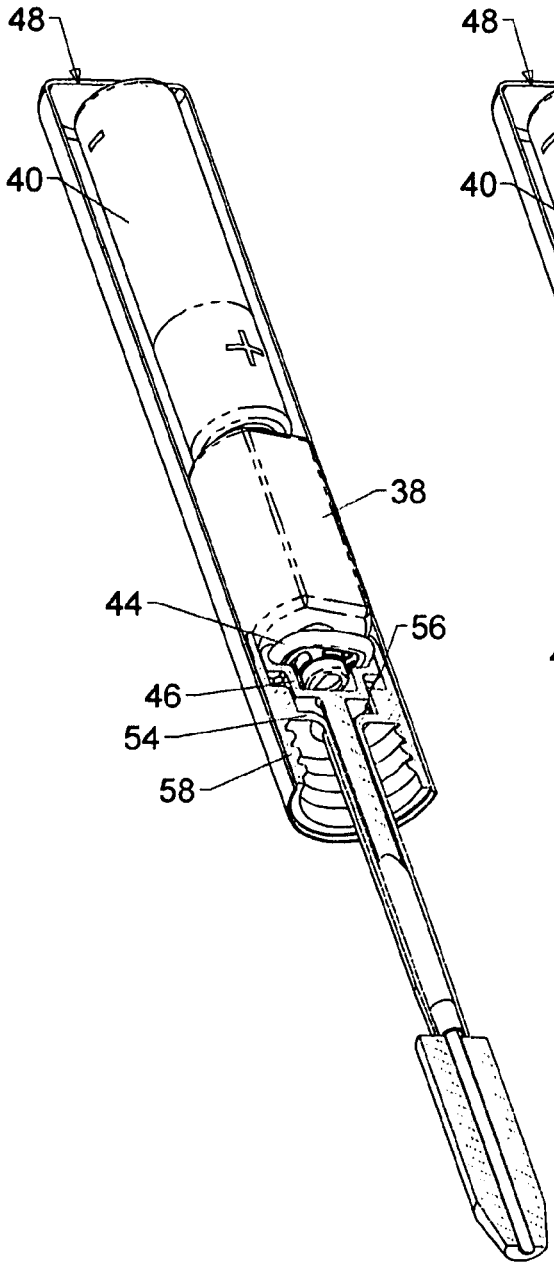
FIGS. 13A and 13B are sectional perspective views of the applicator of FIG. 2, respectively showing the relative positions of the movable elements thereof at minimum and maximum distal extension of the applicator head or brush relative to the applicator handle or cap.
Figure 13B:
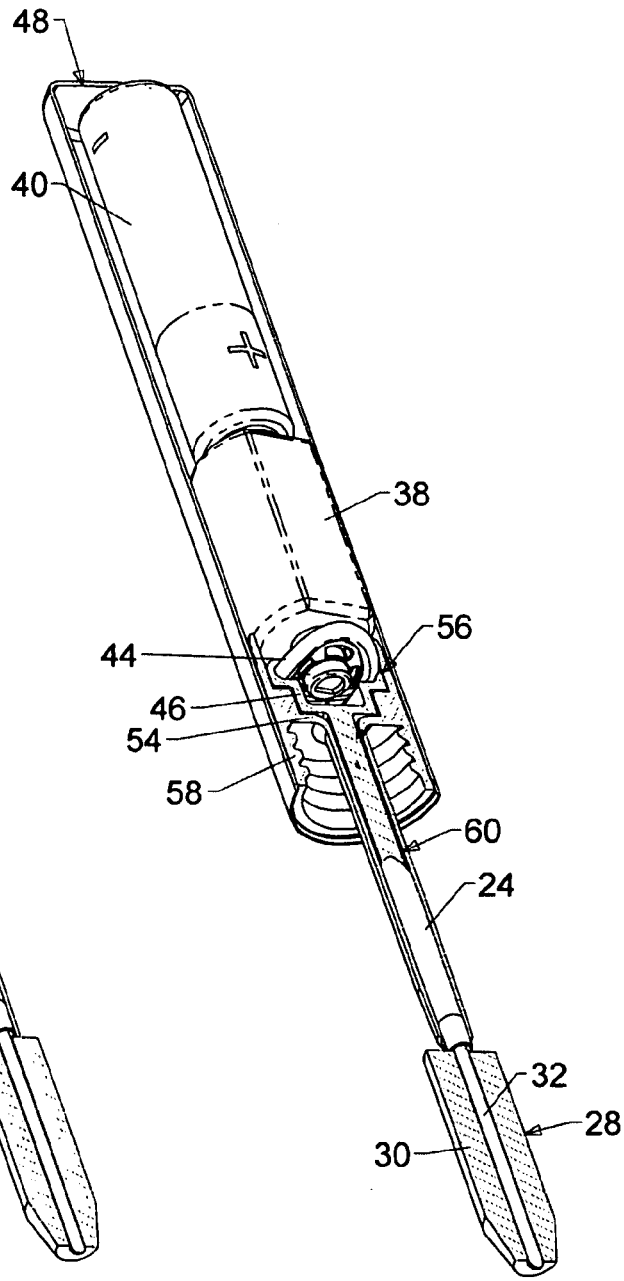

The motor 38, battery 40, cam member 44 and follower 46 are all housed within the cap 20, which is constituted of a hollow cylindrical outer shell 48 with an open distal end 50, and a unitary molded cylindrical insert 52 mounted in the distal portion of the shell 48. The insert is hollow and open at both ends, but is divided internally by an integral transverse wall or septum 54 into a well 56 and a skirt 58 bearing the internal thread 22 for fitting over and engaging the container neck 16. As best seen in FIGS. 13A and 13B, the battery 40 and motor 38 are disposed in the shell between the insert 52 and the proximal end of the shell, with the output shaft 42 of the motor extending into the proximal open end of the well. A motor of suitable dimensions for this arrangement is the "SANYO"™ motor designated "TG-1201", 12 mm×15 mm in size.

A hollow outer stem or sheath 60, open at both ends, is formed integrally with the septum 54 and projects distally therefrom, through and beyond the skirt 58; its proximal end opens through the septum into the well 56.

The inner stem or stem rod 24 of the applicator is inserted in the sheath 60 and extends entirely therethrough, with the cam follower 46 disposed in the well 46 and the brush 28, mounted on the distal end of the stem 24, disposed beyond the distal end of the sheath. The length of the stem 24 between the cam follower and the brush is sufficiently greater than the length of the sheath to enable the stem to move longitudinally, relative to the sheath, over the limited range or distance of reciprocatory movement imparted to the stem 24 by the actuating mechanism. In this arrangement, the sheath 60 serves as a guide for the stem 24, constraining the stem to move only along its long axis; i.e., the stem can slide lengthwise, but cannot move transversely, relative to the sheath.

The cam member 44, shown in FIGS. 8-12, has the general shape of a wheel, with a rounded periphery 62 that is circular in projection on a plane perpendicular to its axis of rotation (FIG. 8) but has four successive undulations 64, 65, 66 and 67 alternatively curving in respectively opposite directions along that axis, as successive crests and troughs spaced 90° apart. The hub 68 of the cam member has a bore 70 of D-shaped cross-section fitting over the correspondingly shaped output shaft 42 of the motor so that the cam member is rotated by the shaft 42 when the motor is operating.

Figure 7:
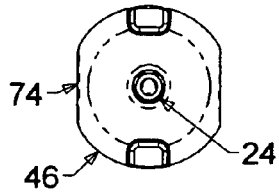
FIG. 7 is a bottom plan view of the stem rod and cam follower of FIG. 4.
Figure 8:
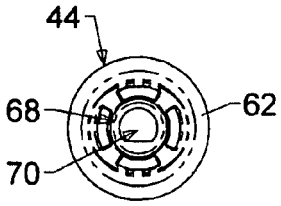
FIG. 8 is a plan view of the cam member of the actuating mechanism provided in the applicator of FIG. 2.
Figure 9:
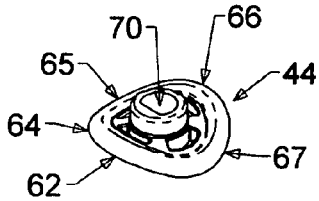
FIG. 9 is a perspective view of the cam member of FIG. 8.
Figure 11:
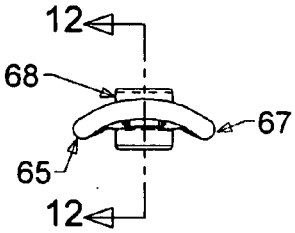
FIGS. 10 and 11 are side views, at 900 angles to each other, of the cam member of FIG. 8.
Figure 12:
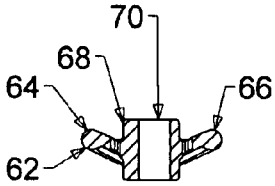
FIG. 12 is a sectional view of the cam member of FIG. 8, taken on plane 12-12 of FIG. 11.
Figure 10:
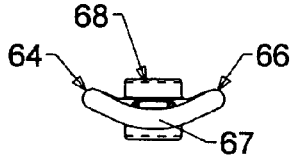

The cam follower 46, shown in FIGS. 4-7, is formed as an enlarged head of the stem 24 and includes two proximally extending curved hooks 72 for slidably engaging short portions of the periphery of the cam member 44 at locations 180° apart around the periphery. The well 56 and cam follower 46 are mutually dimensioned and shaped to permit the cam follower to move, relative to the well, through the full range of limited reciprocatory movement of the stem 24 in the direction of the stem long axis, but to prevent rotation of the cam followers and stem about the latter axis, as will be apparent from the flats 74 on opposite sides of the cam follower (FIG. 7). In assembling the applicator, the stem 24 is inserted through the well into the sheath 60 until the distal end of the stem projects outwardly beyond the distal end of the sheath, and the brush is then mounted in the stem end by inserting the proximal portion of the brush core 32 into an axial bore 76 (FIG. 5) formed in the distal end of the stem.

The periphery of the cam member 44 is inserted into the cam follower hooks 72, being so arranged that the axis of rotation of the cam member (and of the motor output shaft) coincides with the long axis of the stem 24. Thus, as the cam member rotates, sliding though the hooks, the hooks are alternately displaced proximally and distally as the 180°-spaced crests and the 180°-spaced troughs of the cam member undulations successively engage the 180°-spaced hooks.

Figure 14A:
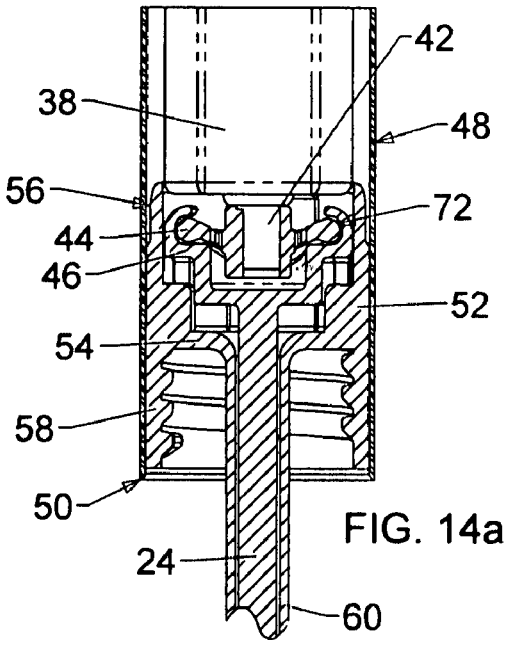
FIGS. 14A and 14B are further enlarged fragmentary sectional side views of the applicator of FIG. 2, respectively showing the relative positions of the cam member, the cam follower, and the cap at minimum and maximum distal extension of the applicator head relative to the applicator handle or cap.
Figure 14B:
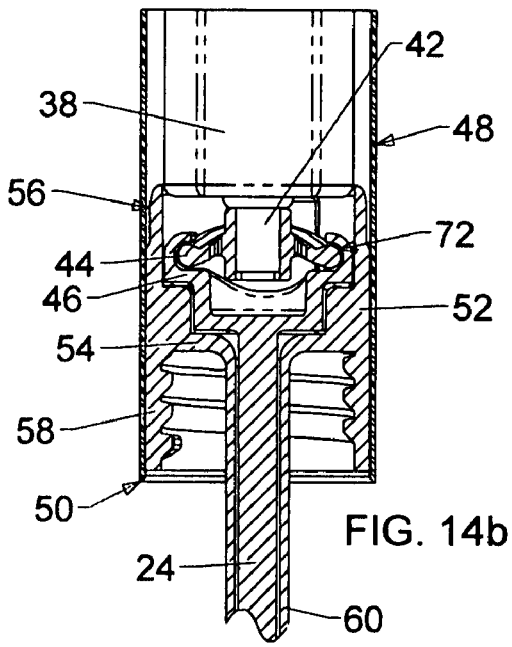

This action, converting rotary motion of the cam member into reciprocatory movement of the cam followers and stem 24 along the long axis of the stem, is illustrated in FIGS. 13A-14B. When the two (proximal) crests 64 and 66 of the cam member periphery are received in the hooks 72, the cam follower and stem 24 are lifted to their proximal limit of movement along the stem long axis (FIGS. 13A and 14A). Thereafter, as the cam member rotates through 90°, the cam follower and stem are displaced distally along the stem long axis until the two (distal) troughs 65 and 67 of the cam member periphery are received in the hooks 72, at which point the cam follower and stem reach their distal limit of movement along the stem long axis (FIGS. 13B and 14B). Consequently, in each complete 360° rotation of the cam member 44, the stem reciprocates twice, i.e., moves back and forth twice between its proximal and distal limits of movement along its long axis.

Figure 15A:
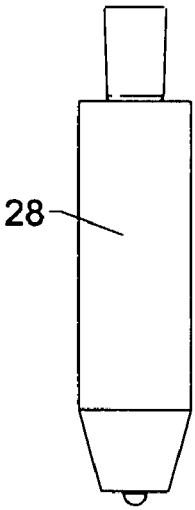
FIGS. 15A and 15B are similarly enlarged fragmentary views, partly in section, of the distal portion of the applicator of FIG. 2, respectively illustrating the relative positions of the brush and outer stem or guide sheath at minimum and maximum distal extension of the applicator head relative to the applicator handle or cap.
Figure 15B:
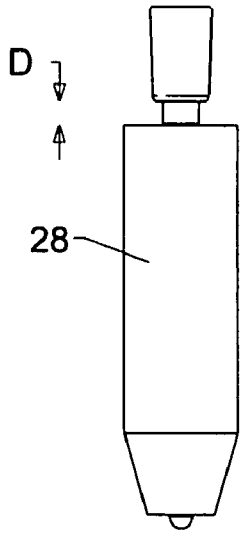

As best seen in FIGS. 15A and 15B, which respectively correspond to the cam and follower positions of FIGS. 14A and 14B, the brush 28 moves longitudinally, with each reciprocatory movement of the stem, between a first position close to the distal end of the sheath 60 (FIG. 14A) and a second position spaced distally from the latter end of the sheath, along the axis of the stem and brush. The linear extent of this motion (represented by distance D in FIG. 15B) is relatively short in relation to the length of the brush 28, and the frequency of reciprocation may be very rapid; for example, if the motor operates at a speed of 200 rpm, the brush would oscillate longitudinally 400 times per minute.

Figure 16:
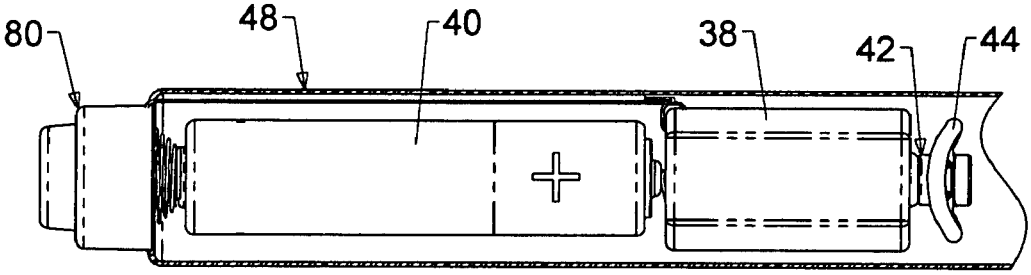
FIGS. 16 and 17 are schematic fragmentary side sectional views of an applicator of the general type shown in FIG. 2, embodying the invention, respectively illustrating two alternative examples of switch arrangements for starting and stopping the motor provided in the applicator.
Figure 17:
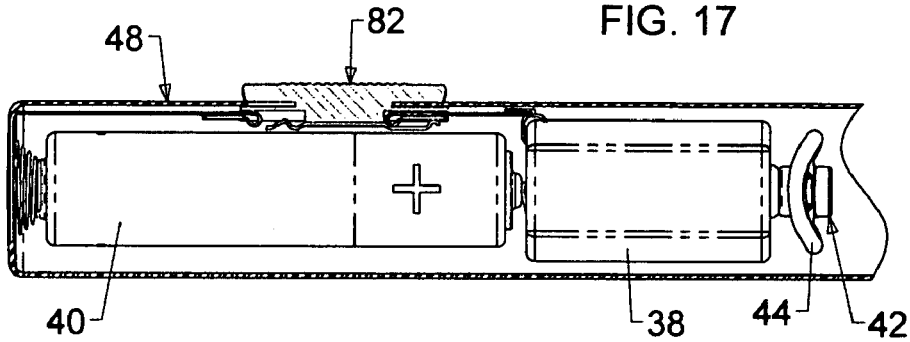

The motor is turned on and off by means of a switch, which may, for example, be a push-button switch 80 located at the proximal end of the cap shell 48, as shown in FIG. 16, or a sliding switch 82 positioned along the side of the shell 48, as shown in FIG. 17.

The use of the dispenser and applicator of FIGS. 1-17 may now be readily understood. To apply mascara to eyelashes, a user performs the customary manipulative operations of removing the cap 20 from the container and, grasping the cap as a handle, stroking the lashes with the mascara-bearing brush, typically with the axis of the brush oriented transversely to the lashes and the strokes directed along the length of the lashes. With the applicator of the invention, the user turns on the motor 38 with the switch before touching the brush to the lashes, so that the brush oscillates with a rapid, short-stroke reciprocatory motion along its axis, across the lashes, at the same time that the user is performing manual strokes of the brush along the lashes. This combination of motions, performed with manipulative ease because the reciprocatory oscillation of the brush is driven, affords superior coverage of the lashes by the mascara. When the brush is ready to be returned to the container, the user turns the motor switch off.

Figure 18:
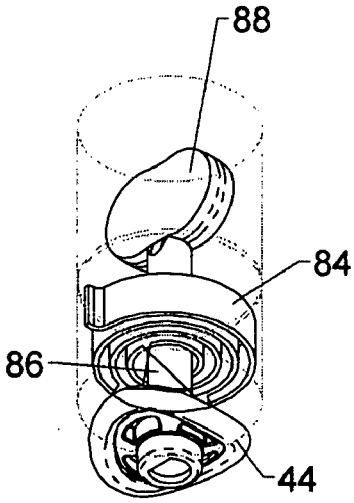
FIGS. 18 and 19 are schematic fragmentary sectional views of embodiments of the invention employing a manually wound torsion spring rather than a motor for driving the stem rod and head in reciprocatory motion.
Figure 19:
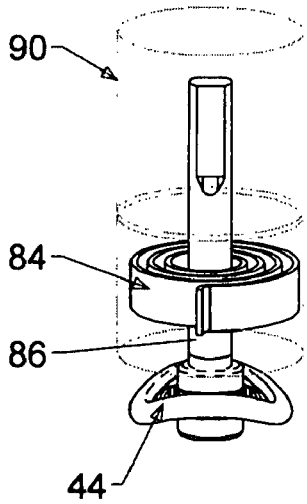

FIGS. 18-19 illustrate another embodiment of the invention in which the battery powered motor 38 of the actuating mechanism of FIGS. 1-17 is replaced with a manually windable torsion spring 84, such as is commonly used in wind-up toys, mounted within the cap shell. A shaft 86 is connected to and driven by the unwinding spring on an axis coincident with the long axis of the applicator stem (not shown in FIGS. 18 and 19) and the D-shaped bore 70 of the hub 68 of cam member 44 is fitted on the shaft 86 so that the tension spring, when wound and released, rotates the cam member. In other respects, the applicator of FIGS. 18 and 19 may be the same in structure and operation as that of FIGS. 1-17, including a cap insert, sheath, stem, brush, and cam follower engaging the cam member 44, all arranged as described above with reference to the latter Figures. A key 88 (FIG. 18) may be provided with or insertable in the cap to wind the spring 84; alternatively, the cap shell may be modified to include a knob 90 (FIG. 19) at its proximal end, connected to the torsion spring shaft 86 and rotatable by a user to wind the spring.

Figure 20A:
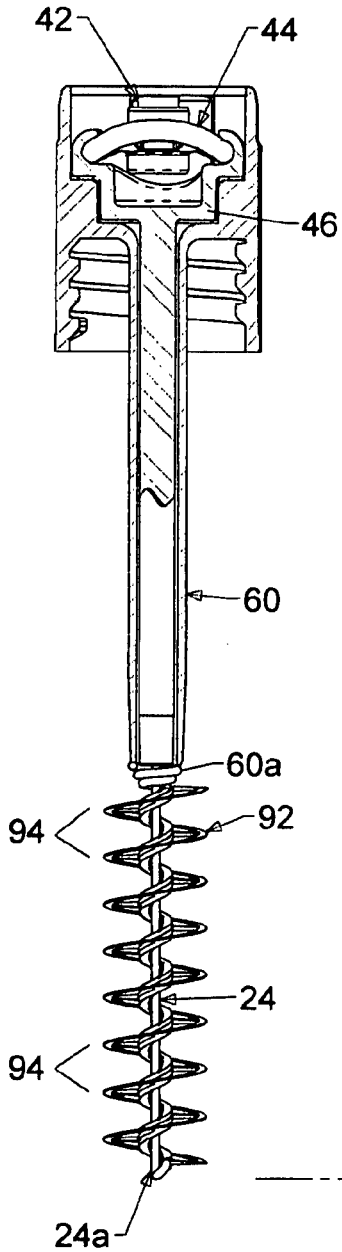
FIGS. 20A and 20B are schematic fragmentary sectional views of a further embodiment of the invention, at maximum and minimum distal extension of the stem rod relative to the cap or handle.
Figure 20B:
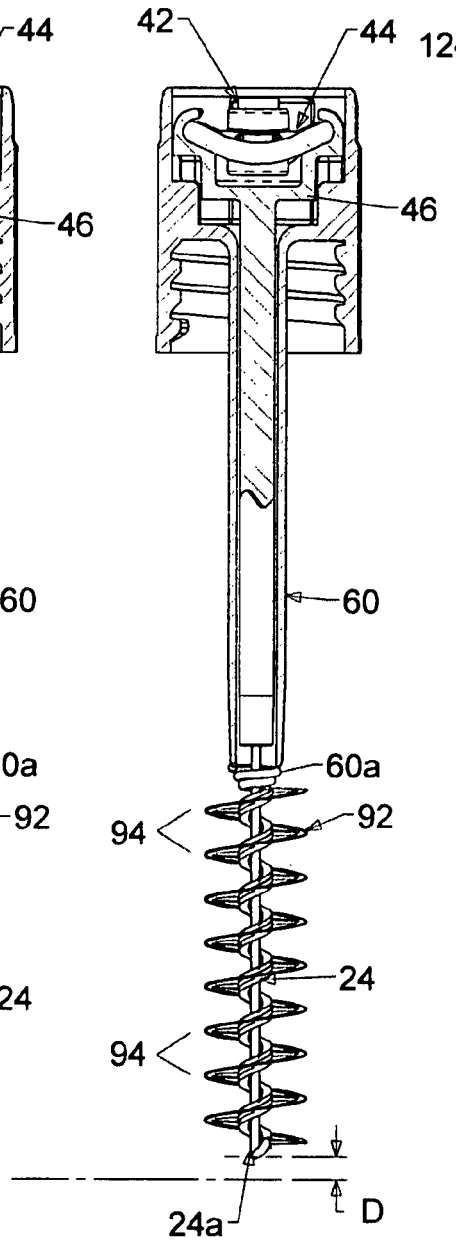

FIGS. 20A and 20B show another modified embodiment of the invention, usable (for example) with either the motor-driven actuating mechanism of FIGS. 1-17 or the spring-driven actuating mechanism of FIGS. 18-19, wherein the brush 28 is replaced by a flexible helical applicator member 92 disposed in coaxial surrounding relation to the stem 24. The distal end of the helical member 92 is fixed to (or bears against) the distal end 24*a* of the stem 24 so as to move longitudinally therewith, and the proximal end of the member 92 is fixed to a side of the distal end 60*a* of the sheath 60 through which the stem projects. Helical member 92 is made of a material suitable for applying mascara to eyelashes, formed into a multiplicity of successive coils or turns 94 (e.g. 32 turns). The motor output shaft 42, cam member 44 and cam follower 46 are constructed and arranged as in FIGS. 1-17 to perform the same function of imparting rapid, short, axially directed reciprocatory motion or oscillation to the stem 24 relative to the cap.

As the stem moves back and forth in relation to the sheath 60 (which is fixed to the cap), the distance along the stem long axis between the distal end 60*a* of the sheath and the distal end 24*a* of the stem repetitively varies, e.g., between a minimum of 1.000 inch and a maximum of 1.063 inches, causing rapid repetitive expansion and contraction of the helical member 92. This expansion and contraction moves the turns 94 of the helical member back and forth along the long axis of the stem; when the turns bear mascara for application to a user's lashes, such movement of the turns has an effect similar to that of the back-and-forth movement imparted by the actuating mechanism of the invention to the bristles or fibers of the brush 28 in the embodiments described above.

Figure 21:
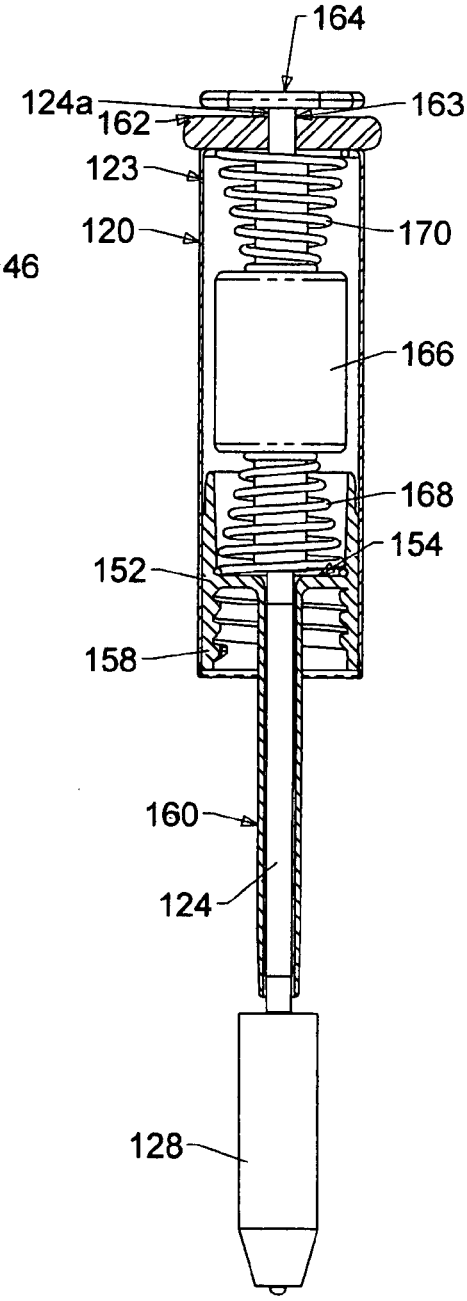
FIG. 21 is a schematic sectional view of yet another embodiment of the invention.

An alternative type of actuating mechanism for the applicator, incorporating an inertial drive, is illustrated in FIG. 21. In this embodiment, the cap 120 is a rigid hollow structure defining an internal chamber 123. The inner stem or stem rod 124 of the applicator, bearing a mascara brush 128 at its distal end, extends through this chamber (e.g. substantially coaxially therewith). The distal end of the cap is provided with a molded plastic insert 152 having a transverse septum 154 at its inner (proximal) end, a distally opening and internally threaded skirt 158 for seating on and closing the neck of a mascara container, and an outer stem or sheath 160, open at both ends and projecting distally through and well beyond the skirt 156, to receive and guide the stem 124 in the same way that the sheath 60 guides the stem 24 in the embodiment of FIGS. 1-17. The proximal end of the cap is closed by a rigid anvil member 162 having a central opening 163 through which a proximal end portion 124*a* of the stem 124 extends. A push button 164 is mounted on the proximal stem end.

Within the chamber 123 but spaced from the ends thereof is disposed a weight 166 attached to the stem 124. The weight is disposed between and in tandem with two coil springs 168 and 170 each substantially coaxially surrounding the stem 124 in the chamber 123. Spring 168 acts between the distal end of the chamber (septum 154) and the weight, while spring 170 acts between the weight and the proximal end of the chamber (anvil 162). The weight 166 is freely slidable in the chamber, together with the stem 124 to which it is attached, back and forth in the direction of the long axis of the stem.

When the anvil is struck on a hard surface, the resultant forces displace the weight along the latter axis within the chamber, and the weight then oscillates back and forth, acted on by the two springs. The stem 124 and the brush 128 carried by the stem correspondingly oscillate back and forth along the stem long axis, because the stem is attached to the weight. Again, if the button 164 is pushed manually to displace the weight along the stem long axis, the springs cause oscillation of the weight and of the stem and brush. Thus, an axially directed oscillatory motion is imparted to the brush, at the same time that a user may be manipulating the brush in strokes along the lashes.

Figure 2:
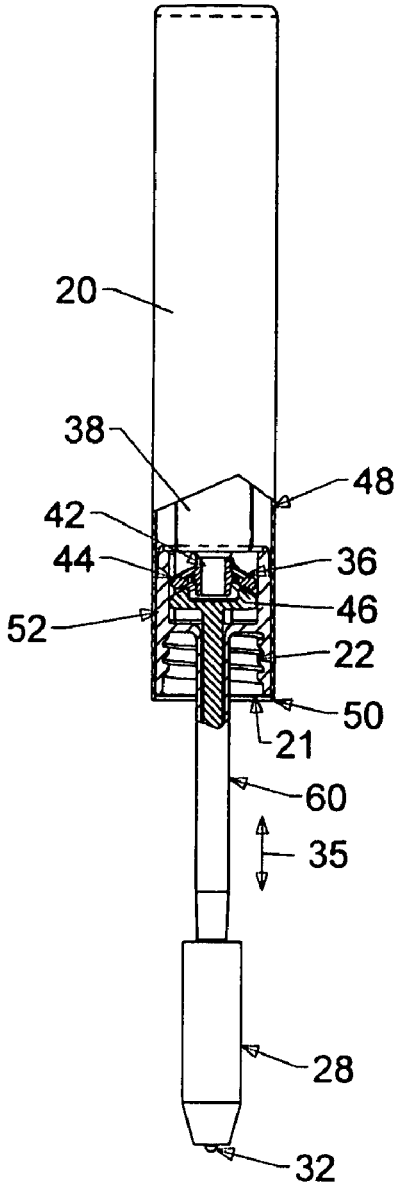
FIG. 2 is an enlarged side view, partly in section, of the applicator of the dispenser of FIG. 1.
Figure 3:
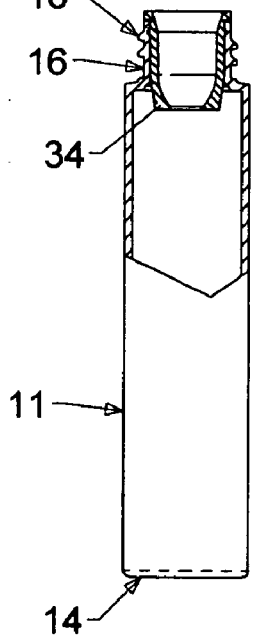
FIG. 3 is an enlarged side view, partly in section, of the container of the dispenser of FIG. 1.
Figure 2A:
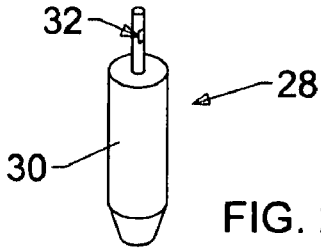
FIG. 2A is a perspective view of a mascara brush which serves as the head of the applicator of FIG. 2.
Figure 4:
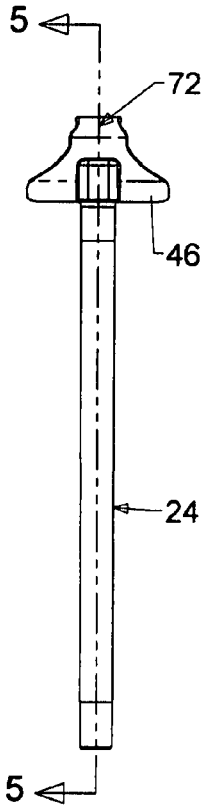
FIG. 4 is a slightly further enlarged side view of the inner stem or stem rod of the applicator of FIG. 2, having a cam follower formed at its proximal end.
Figure 5:
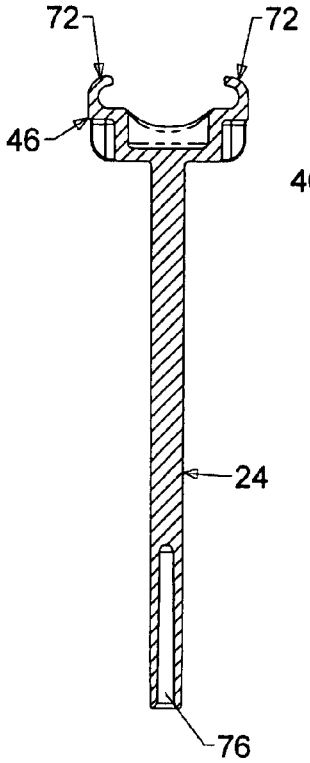
FIG. 5 is a sectional side view, taken on plane 5-5 of FIG. 4, of the stem rod and cam follower of FIG. 4.
Figure 6:
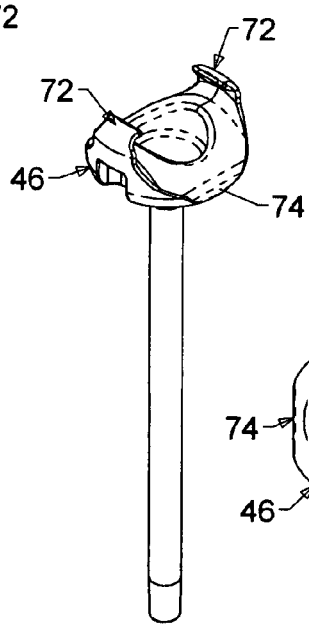
FIG. 6 is a perspective view of the stem rod and cam follower of FIG. 4.
Figure 22:
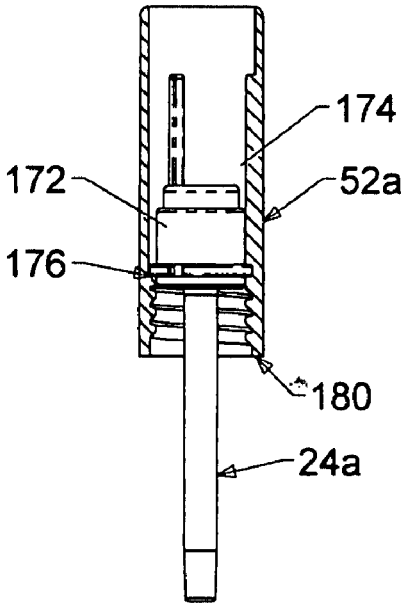
FIGS. 22 and 23 are simplified fragmentary longitudinal sectional views of alternative structural arrangements of the stem and handle for guiding stem movement.
Figure 23:
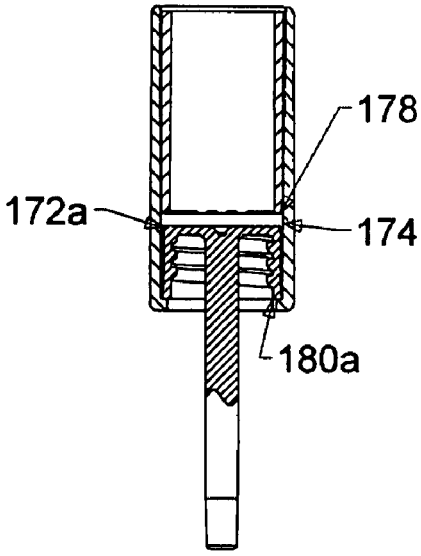

FIGS. 22 and 23 illustrate modified forms of the insert 52 and stem 24 of FIG. 2, in which the sheath 60 is omitted and its stem-guiding function is performed by a portion of the insert that laterally surrounds and is slidably engaged by an enlarged proximal portion of the stem. Thus, in FIG. 22, the stem (here designated 24*a*) is formed with a proximal enlarged portion 172 that fits slidably within a guide portion 174 of the insert (here designated 52A). Stem portion 172 and guide portion 174 are mutually shaped and dimensioned to permit the stem 24*a* to move along its long axis relative to the insert 52*a* but not to rotate or move in other directions; a ledge 176, at the distal end of guide portion 174, limits movement of the stem in the axial portion 174, limits movement of the stem in the axial direction as well. Another configuration of the guide and stem portions is shown in FIG. 23, where the guide portion 174*a* also includes a ledge 178 at its proximal end for limiting movement of the stem portion 172*a* in that direction. Each of the assemblies of FIGS. 22 and 23 includes a threaded skirt for mounting the cap on the neck of a mascara container; in FIG. 22, the skirt 180 is the distal extremity of the insert 52*a*, while in FIG. 23, the skirt 180*a* is the distal extremity of the enlarged stem portion 172*a*. For simplicity, the cam member and cam follower have been omitted from FIGS. 22 and 23.

Figure 24:
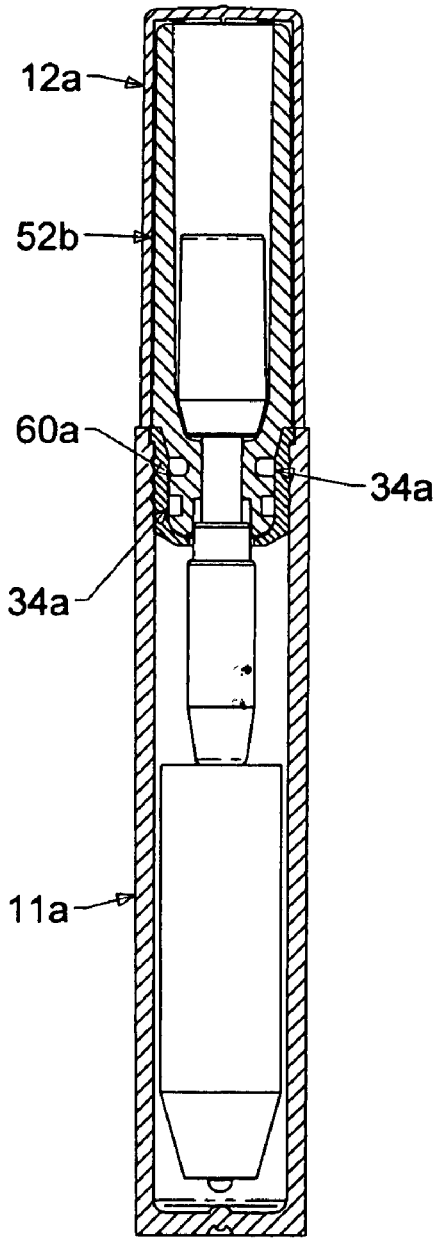
FIG. 24 is simplified longitudinal sectional view of a modified arrangement for securing the cap to the container of a mascara or like dispenser embodying the invention.

As shown in FIG. 24, the threads on the cap and container neck of the dispenser of FIG. 2 may be replaced by a snap-fitting or press-fitting arrangement for securing the cap 12*a* to the container 11*a*. Such an arrangement is exemplified by an insert 52*b* having a sheath portion 60*a* in the cap, and a wiper element 34*a* mounted in the container 11*a*, mutually shaped and dimensioned to provide a snap-fit or press-fit seal when the distal end of the cap is inserted into the container opening.

FIGS. 25-28 illustrate a modification of the cam member 44 of FIGS. 2 and 8-12. In the cam member 44*a* of FIGS. 25-28, the periphery 62*a* is rounded and circular as viewed in projection on a plane perpendicular to its axis (FIG. 25), but has no formed undulations. Instead, the cam member periphery is tilted at an oblique angle to its axis of rotation (the axis of hub 68*a*) so that it has in effect one "high" side 64*a* and one "low" side 65*a*, 180° apart. Thus, in each revolution of the cam member 44*a* there is a single up-and-down undulatory movement past any given point. For use with the cam member 44*a*, the cam follower has a single curved hook 72*a* (FIG. 28) slidably engaging the periphery 62*a*. This hook, together with the stem to which it is connected, undergoes a single back-and forth reciprocation along the stem long axis during each single complete revolution of the cam member; i.e., there is a 1:1 ratio of stem reciprocation to cam member rotation in the case of cam member 44*a*, in contrast to the 2:1 ratio in the case of cam member 44 described above. Other integral ratios (say, 3:1 or 4:1) are possible if the stroke (distance of stem reciprocation) is small enough and the speed (rpm) of the motor is limited, such ratios being provided by increasing the number of undulations formed in the cam member periphery.

Figure 31:
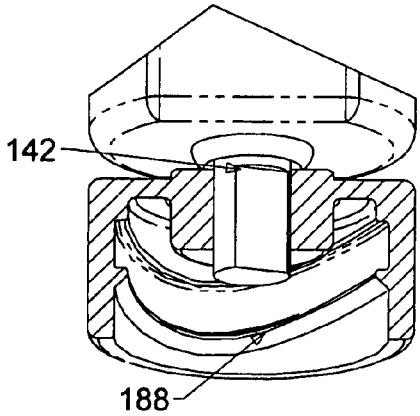
FIG. 31 is a sectional perspective view of the cam member of the applicator of FIG. 29.
Figure 29:
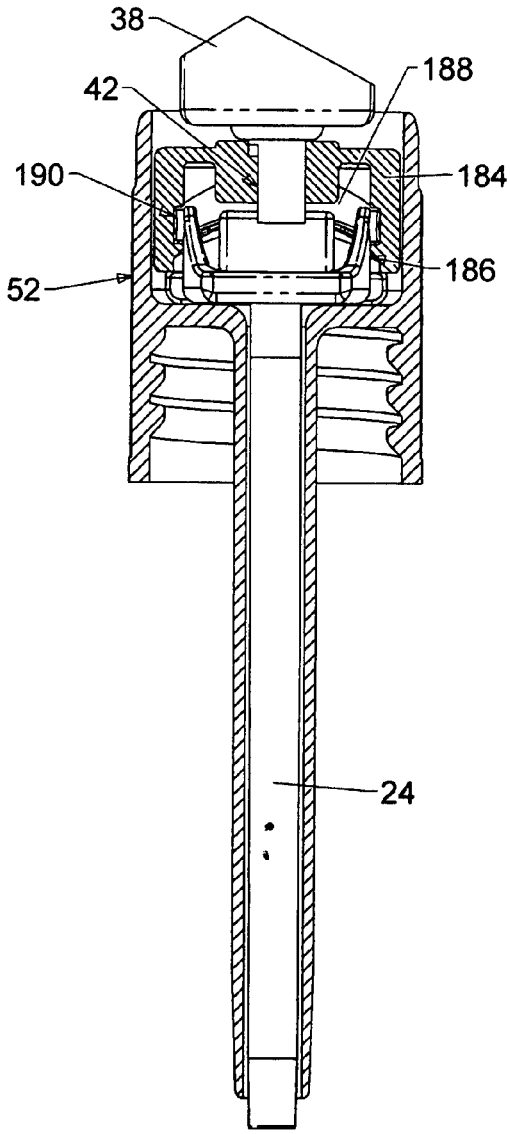
FIG. 29 is a fragmentary longitudinal sectional view of another embodiment of the applicator of the invention.
Figure 30:
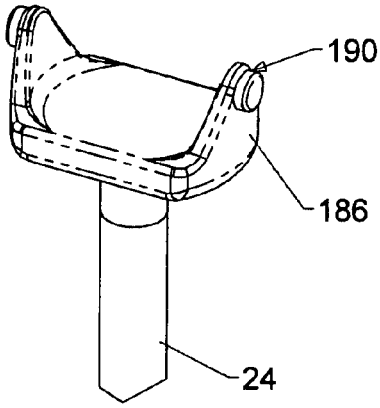
FIG. 30 is a perspective view of the stem and cam follower of the applicator of FIG. 29.
Figure 25:
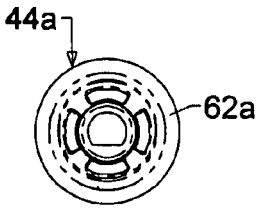
FIG. 25 is a plan view of a modified form of cam member for the applicator of the invention.
Figure 26:
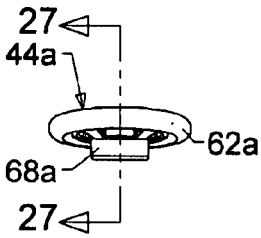
FIG. 26 is a side view of the cam member of FIG. 25.
Figure 27:
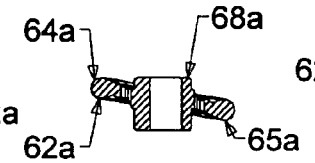
FIG. 27 is a sectional side view of the cam member of FIG. 25, taken on plane 27-27 of FIG. 26.
Figure 28:
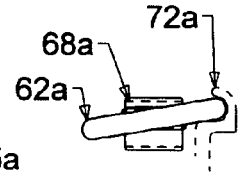
FIG. 28 is another side view of the cam member of FIG. 25, at 180° to the view of FIG. 27.

In the embodiment of FIGS. 29-31, the cam member 44 or 44*a* and cam follower 46 are replaced by a cup-shaped, distally open cam member 184 and a cam follower 186 formed at and integrally with the proximal end of the stem 24. The cam member 184 has a cylindrical inner wall laterally surrounding the cam follower and formed with a continuous (endless) undulatory groove 188, while the cam follower bears a pair of pins or projections 190, located 180° apart and both inserted within (riding in) the groove 188 so that each pin slidably engages the groove side walls. As in the embodiment of FIG. 2, the cam member engages the output shaft 42 of the motor 38 for rotation therewith about an axis coincident with the long axis of the stem. Rotation of the stem and cam follower is prevented by interference between the cam follower and the surrounding portion of the cap insert 52, as indicated by flat side surfaces of the cam follower 186 shown in FIG. 30.

As the motor 38 rotates the cam member 184, the undulations of the groove 188 sliding past the pins 190 move the pins, and the stem 24 with them, alternatively back and forth along the stem long axis. The ratio of the number of times the stem moves back and forth for each complete revolution of the cam member is determined by the number of undulations formed in the groove.

Figure 31A:
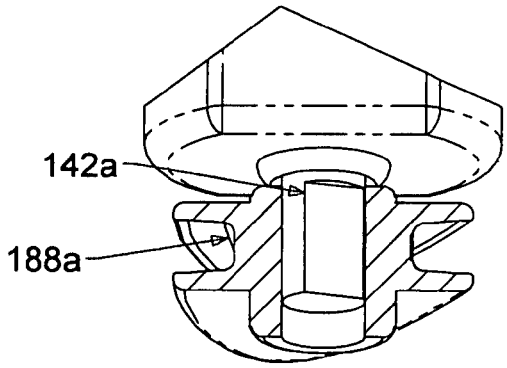
FIGS. 29A, 30A and 31A are views respectively corresponding to FIGS. 29, 30 and 31, of a modification of the FIG. 29 applicator.
Figure 30A:
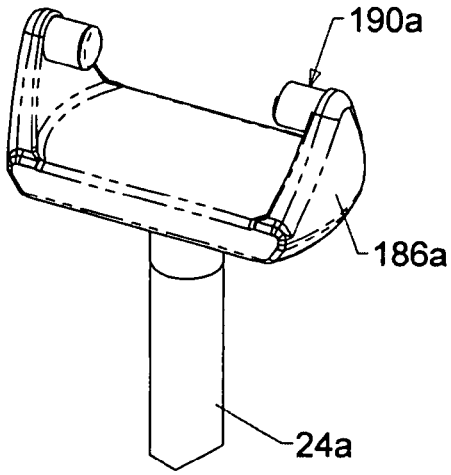
Figure 29A:
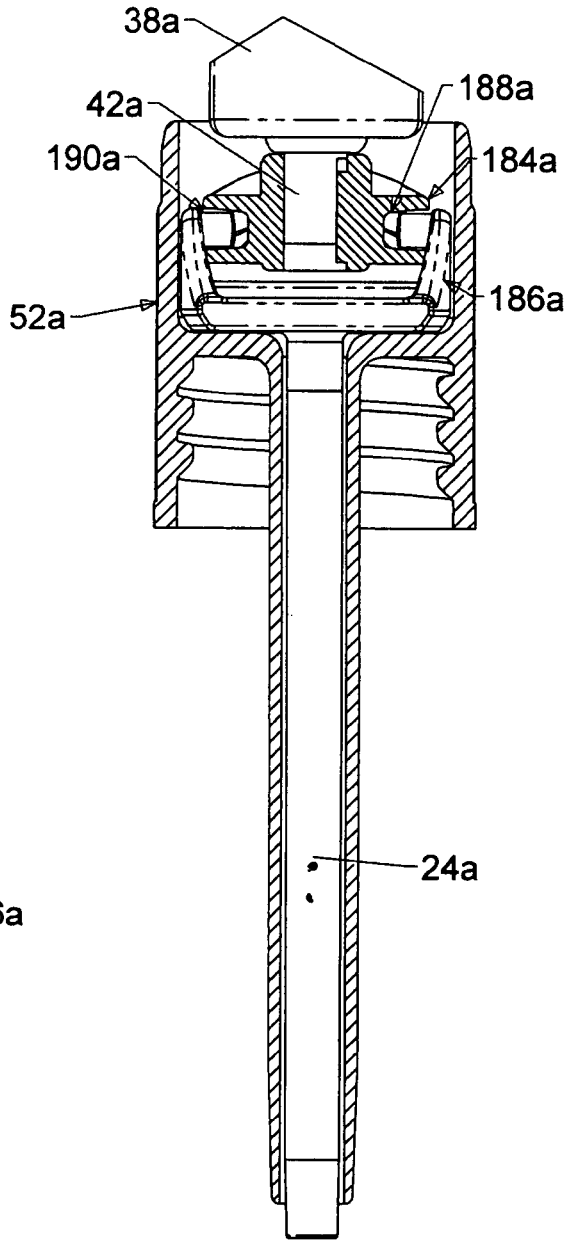

The modified embodiment of FIGS. 29A, 30A and 31A has a cup-shaped, distally open cam member 184*a* laterally surrounded by (rather than, as in FIGS. 29-31, surrounding) a cam follower 186*a* formed at and integrally with the proximal end of the stem 24. Thus, the cam member 184*a* has a cylindrical outer wall laterally surrounded by the cam follower and formed with a continuous (endless) undulatory groove 188*a*, while the cam follower bears a pair of pins or projections 190*a*, located 180° apart and both inserted within (riding in) the groove 188*a* so that each pin slidably engages the groove side walls. As in the embodiment of FIGS. 29-31, the cam member engages the output shaft 42 of the motor 38 for rotation therewith about an axis coincident with the long axis of the stem. Rotation of the stem and cam follower is prevented by interference between the cam follower and the surrounding portion of the cap insert 52, as indicated by flat side surfaces of the cam follower 186*a* shown in FIG. 30A.

As the motor 38 rotates the cam member 184*a*, the undulations of the groove 188*a* sliding past the pins 190*a* move the pins, and the stem 24 with them, alternatively back and forth along the stem long axis. The ratio of the number of times the stem moves back and forth for each complete revolution of the cam member is determined by the number of undulations formed in the groove.

Figure 34:
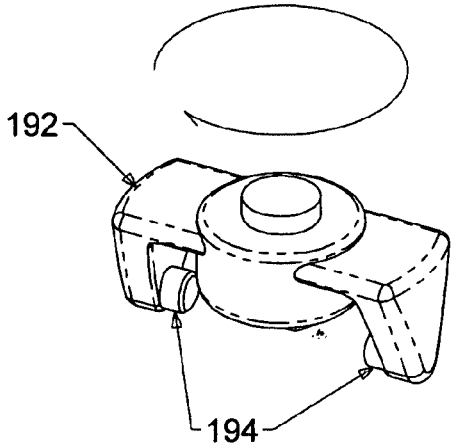
FIG. 34 is a perspective view of the cam member of the applicator of FIG. 32.
Figure 33:
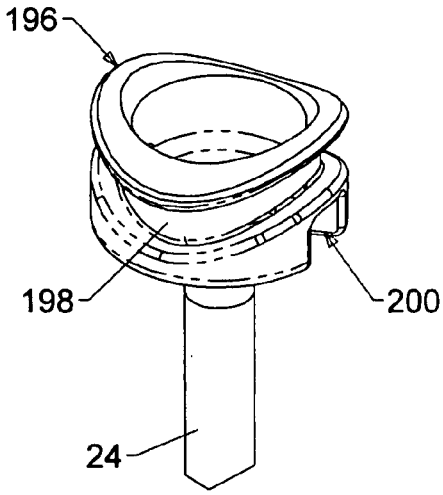
FIG. 33 is a is a perspective view of the stem and cam follower of the applicator of FIG. 32.
Figure 32:
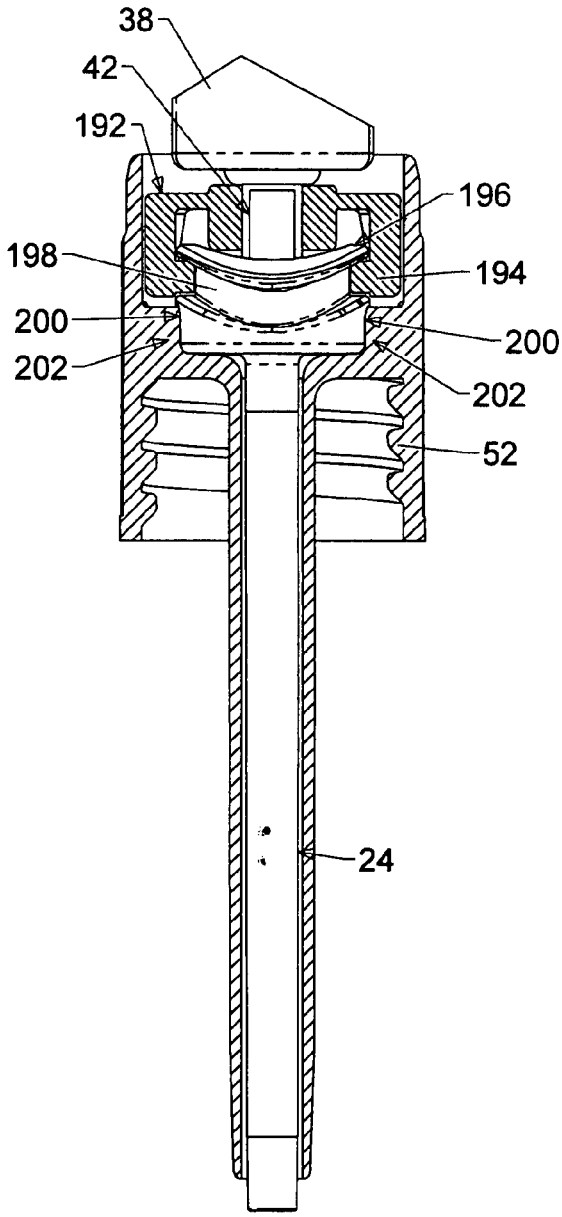
FIG. 32 is a fragmentary longitudinal sectional view of a further embodiment of the applicator of the invention.

A modification of this embodiment, shown in FIGS. 32-34, includes a cam member 192 bearing two opposed inwardly projecting pins 194, mounted on the output shaft 42 of the motor 38 for rotation therewith, and a cam follower 196 fixedly secured to the proximal end of the stem 24, having a cylindrical outer surface formed with an endless undulatory groove 198 in which the cam member pins ride. That is to say, the embodiment of FIGS. 32-34 differs from that of FIGS. 29-31 in that the pins are carried by the cam member and the undulating groove is formed on an outer cylindrical surface of the cam follower. Slots 200 provided in the distal portion of the cylindrical cam follower 196 receive fins 202 formed in the cap insert 52 to prevent the cam follower from rotating. Thus, as the cam member 192 rotates with its pins 194 slidably engaging the side walls of the cam follower groove 198, the pins move the cam follower (and the stem 24) back and forth along the stem long axis in correspondence with the undulations of the cam follower groove.

FIGS. 35 and 35A-35D show an embodiment of the invention in which the cap 12 contains a motor 38*a* that rotates an output shaft 42*a* about an axis that is transverse (perpendicular) to the long axis of the stem 24. Shaft 42*a* carries a rotor 204 that rotates with the shaft and has a periphery, eccentric to the shaft axis, that slidably engages the inner surface of a ring 206 secured to the proximal end of the stem 24. The relative dimensions and configurations of the sliding eccentric rotor 204 and ring 206 are such that, as illustrated in FIGS. 35 and 35A-35D, during each complete rotation of shaft 42*a* the stem is caused to undergo one complete reciprocation along its long axis without being subjected to any laterally directed movement. As one alternative (not shown), instead of the sliding mechanism just described, the output shaft can bear a rotor that carries an eccentrically disposed pivot, while a second pivot (axially parallel to the first-mentioned pivot) is mounted on the proximal portion of the stem and a rigid connector bar or link member extends between and has its two ends respectively pivotally connected to the two pivots, thereby providing a double-pivoted linkage between the rotor and the stem that converts rotation of the rotor to reciprocation of the stem, with a stroke length equal to the diameter of the rotary path of the first-mentioned pivot about the output shaft.

Another embodiment of the invention, illustrated in FIG. 36, utilizes a solenoid 210 mounted in the cap or handle (not shown in FIG. 36) rather than a rotary motor. An example of a commercially available solenoid with suitable dimensions is that designated "RG-O-0421S" (Richmeg Industry Co., Ltd., Taichung, Taiwan). The solenoid, as schematically shown, includes a coil 212 surrounding a plunger 214 aligned with the long axis of the stem 24 and connected to the proximal end of the stem so that longitudinal movement of the plunger directly pushes and pulls the stem back and forth along the stem long axis. Passage of electric current through the coil wire causes the magnetic core (plunger) to move.

Figure 37A:
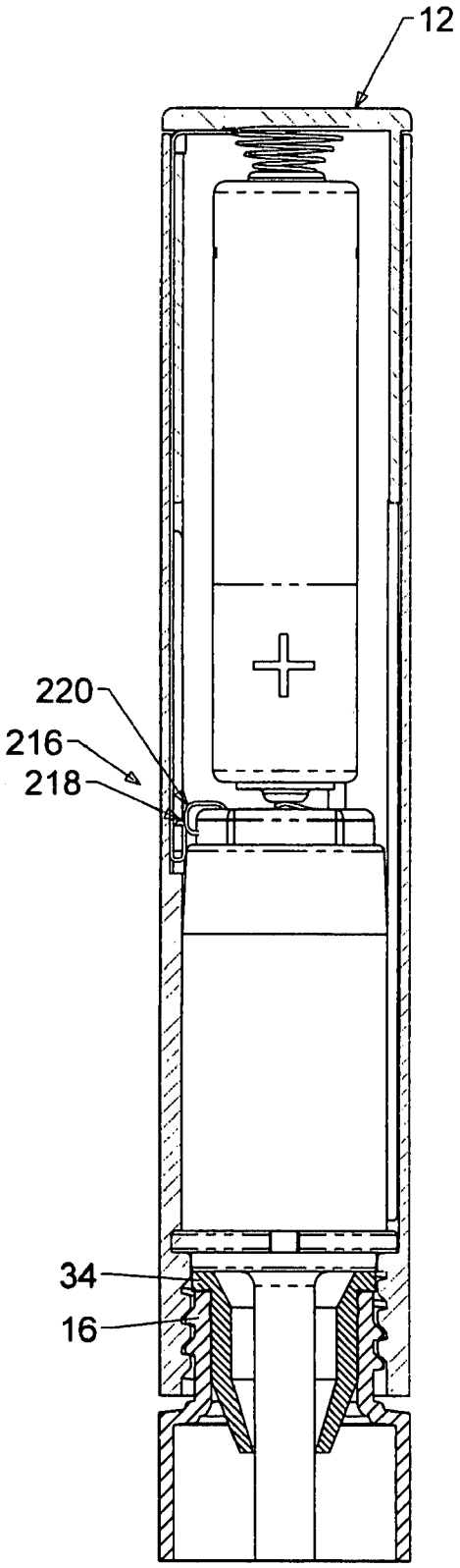
FIGS. 37A and 37B are longitudinal sectional views of a dispenser having a switch that can be used in embodiments of the invention, respectively showing the switch in closed and open positions.
Figure 37B:
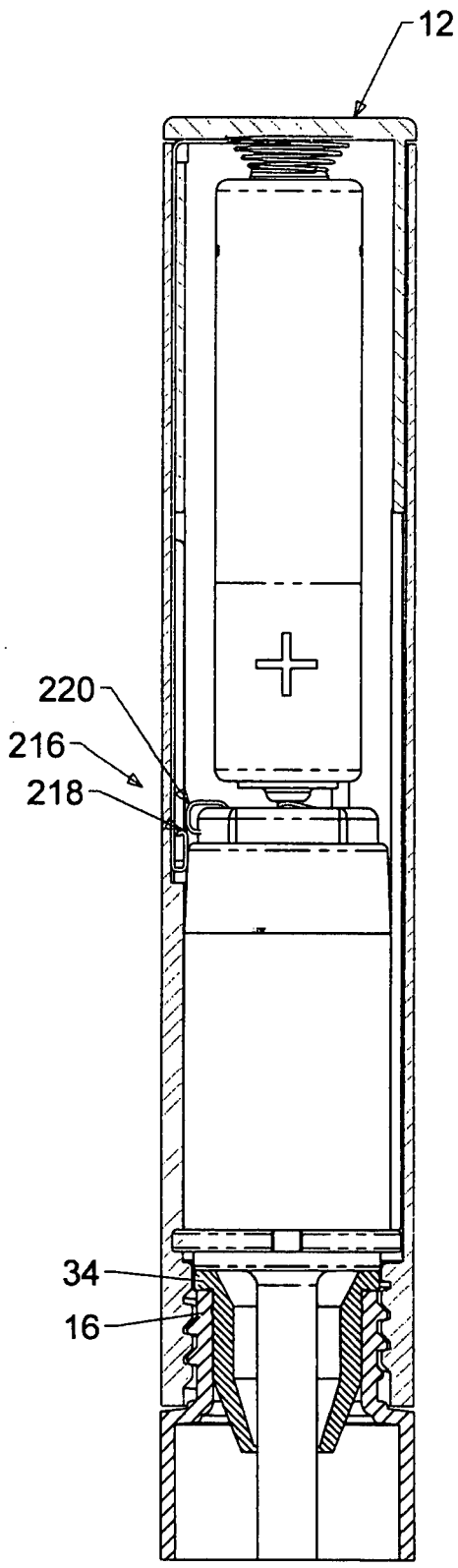
Figure 38A:
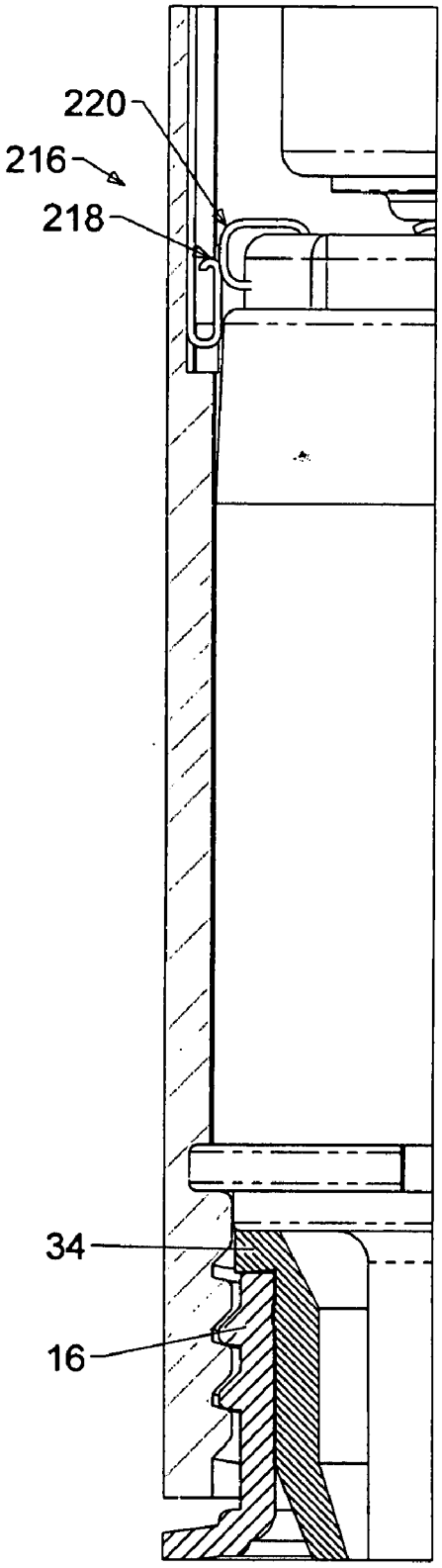
FIGS. 38A and 38B are enlarged views of the same switch and associated structures, corresponding to FIGS. 37A and 37B.
Figure 38B:
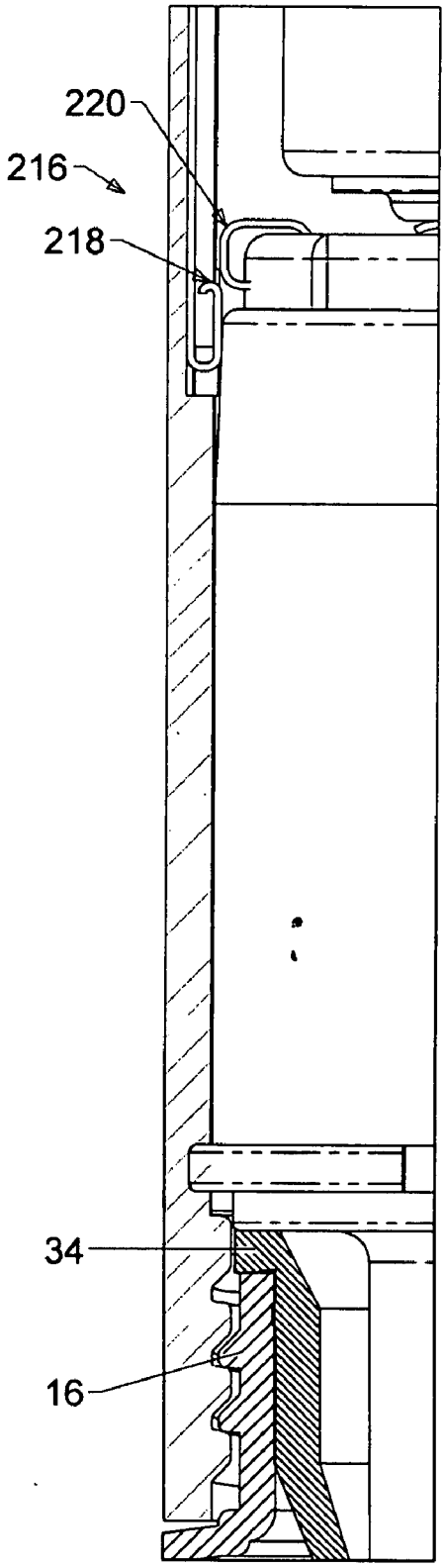

For operating the motor or solenoid, as an alternative to the manual switches exemplified in FIGS. 16 and 17 above, there may be provided a switch that automatically closes (turning the motor on) as the cap 12 is disengaged from the container neck 16, and re-opens (turning the motor off) when the cap is returned to and tightened on the neck. As shown in FIGS. 37A-38B, the switch 216 includes two resilient metal contacts 218 and 220 respectively mounted on relatively longitudinally movable portions of the cap structure, in such positions that when the cap is fully tightened on the neck, pressure of the wiper element 34 against the cap portion bearing contact 220 displaces it away from contact 218, opening the switch (FIGS. 37B and 38B), but as the cap is removed from the neck, this pressure is relieved and contact 220 engages contact 218, closing the switch and thereby completing an electrical circuit to energize the motor or solenoid (FIGS. 37A and 38A).

Figure 39A:
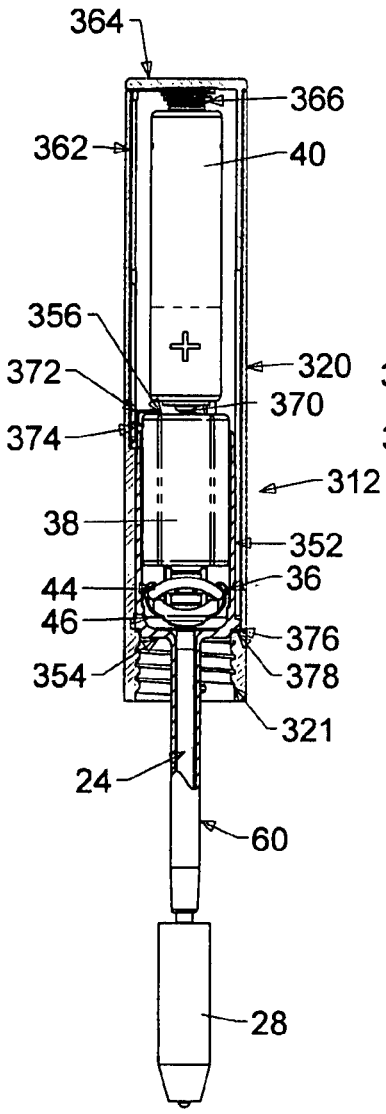
FIGS. 39A, 39B and 39C are longitudinal sectional views of a dispenser embodying the invention and incorporating a modified switch, shown in closed (39B) and open (39C) positions.
Figure 39B:
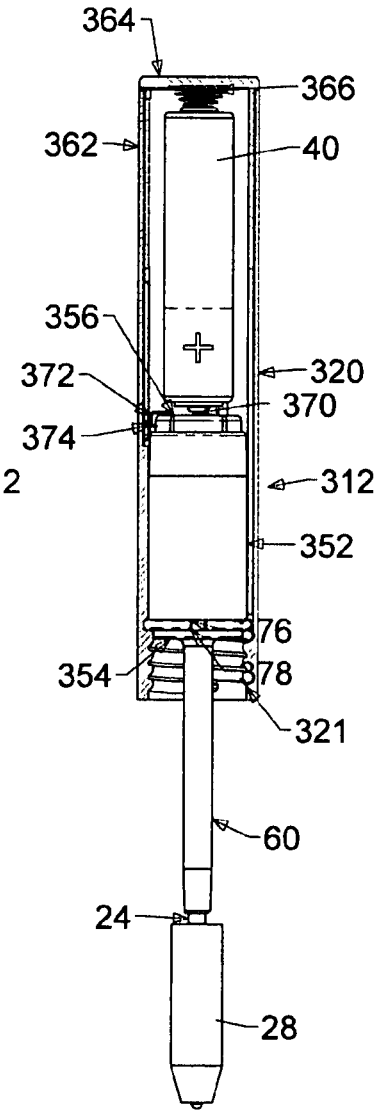
Figure 39C:
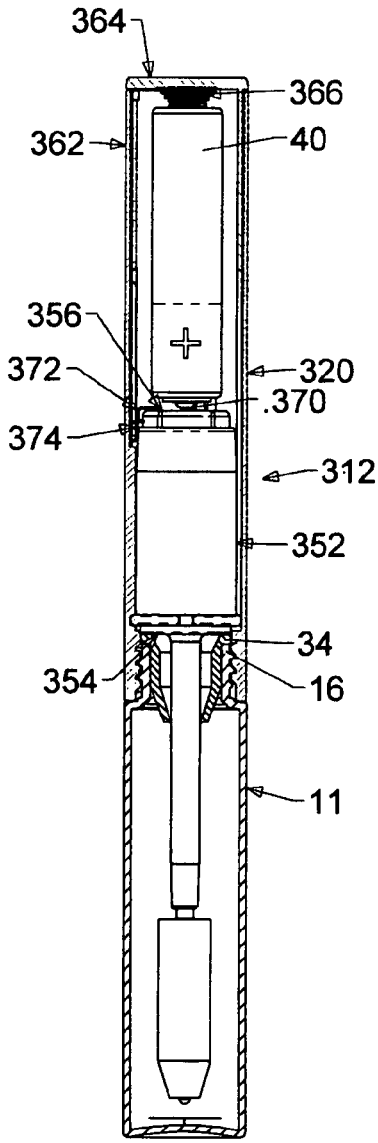

FIGS. 39A-39C illustrate another embodiment of the invention having an automatic switch. In this embodiment, as in that of FIGS. 1-15B, limited reciprocatory motion is imparted to mascara brush 28 at the end of stem 24 extending through sheath 60 by means of actuating mechanism 36, all as described above. The applicator 312 of FIGS. 39A-39C, however, is constituted of two coaxial subassemblies, viz., a cap 320 and a sliding head 352 received within the cap so as to be movable relative thereto along their common axis.

The cap 320 is a rigid hollow shell having an open, internally threaded distal end portion 321 for seating on and engaging the threaded neck 16 of mascara container 11 in which wiper element 34 is disposed (FIG. 39C). The sliding head includes a casing 356 in which actuating mechanism 36 (including electric motor 38, cam member 44 and cam follower 46) is mounted; the proximal end of sheath 60 is integral with, and opens through, the distal end 354 of the casing, while the proximal end of stem 54 extends into the casing interior where it is fixed to (formed integrally with) cam follower 46. The actuating mechanism, stem and sheath function in the same manner as the corresponding elements in the device of FIGS. 1-15B to produce limited reciprocatory motion of the stem and brush relative to the sheath and casing.

Within the cap 320 is a battery casing 362 holding battery 40 between the casing 356 and the proximal end 364 of the cap. A spring 366, under compression between the cap end 364 and the facing end (negative terminal) of battery 40, urges the battery toward the casing 356 so that the positive terminal of the battery is in maintained engagement with one electrical contact 370 of motor 38 at all times. The second contact of the motor is a first resilient metal switch contact 372 positioned on the outer side of the casing 356, and the negative terminal of the battery is connected electrically to a second resilient metal switch contact 374 mounted on the inner wall of the cap so as to be engageable by and separable from contact 372 depending on the relative positions of the cap and sliding head along their common axis.

As shown in FIG. 39B, when the cap is not threadedly seated on container neck 16, the spring 366 forces the casing 356 to its distal limit of movement within the cap, at which an outwardly projecting flange 376 on the casing engages an inwardly projecting annular stop flange 378 within the cap. In these relative positions of the cap and sliding head, the switch contacts 372 and 374 engage each other to close an electrical circuit connecting the motor and battery. The motor is thereby energized to drive the stem and brush through cam member 44 and cam follower 46 in limited reciprocatory motion in the manner described above with reference to FIGS. 1-15B.

When the cap is threaded on container neck 16 (FIG. 39C), wiper element 34 in the neck pushes the distal end 354 of the casing 356 against the force of the spring 366, causing the head 352 to slide in a proximal direction in the cap, with the result that the switch contacts 372, 374 are separated from each other, opening the battery-motor circuit and stopping the motor.

It is to be understood that the invention is not limited to the features and embodiments hereinabove specifically set forth but may be carried out in other ways without departure from its spirit.

What is claimed is:

1. An applicator for cosmetic material, comprising:

(a) an applicator head for transporting a quantity of a cosmetic material and applying it to an end use location;

(b) a stem having a long axis, a distal portion bearing at least a portion of the applicator head, and a proximal portion;

(c) a manually graspable handle connected to the proximal portion of the stem so as to permit limited reciprocatory movement of the stem along the stem long axis relative to the handle, the distal portion of the stem projecting from the handle; and (d) actuating mechanism, carried by the handle, for imparting such reciprocatory movement to the stem relative to the handle, wherein the stem is received in the handle for guided sliding movement of the stem, relative to the handle, back and forth along the stem long axis;

wherein the handle includes a guide slidably engageable by the stem to limit the movement of the stem, relative to the handle, to directions along the long axis of the stem;

wherein the actuating mechanism includes a drive disposed within the handle and having a rotary output shaft, a cam member rotated by the output shaft and a nonrotatable cam follower connected to the stem at a proximal location thereof and slidably engaging the cam member, the cam member and cam follower being mutually configured to convert rotary motion of the output shaft to reciprocatory movement of the stem along the axis;

wherein the output shaft and the stem are coaxial, and the cam member and follower slidingly engage at a locus of contact that undulates along the stem long axis as the cam member rotates, reciprocating the follower and the stem connected thereto in correspondence with the undulations of the locus of contact; and wherein one of the cam member and cam follower has a cylindrical surface formed with an undulating endless groove and the other of the cam member and follower has a projection that rides in the groove so as to move the follower and the attached stem back and forth.

2. An applicator as defined in claim 1, wherein the guide is an open-ended guide sheath through which the stem slidably extends with the applicator head disposed distally of the guide sheath.

3. An applicator as defined in claim 1, wherein the drive is a motor disposed within the handle.

4. An applicator as defined in claim 3, wherein the motor is battery powered and is controlled by a switch on the handle.

5. An applicator as defined in claim 1, wherein the actuating member comprises an electrically energized drive controlled by a switch carried in the handle.

6. An applicator as defined in claim 1, wherein the applicator head is a mascara brush secured to the stem distal portion and the handle is a cap removably mountable on an opening of a mascara container for closing the opening with the distal portion of the stem projecting through the opening into the interior of the container.

7. An applicator as defined in claim 6, wherein the stem is received in the cap for guided sliding movement of the stem, relative to the handle, back and forth along the stem long axis; wherein the guide includes a sheath; and wherein the actuating mechanism includes a drive disposed within the cap and having a rotary output shaft coaxial with the stem, a cam member rotated by the output shaft and a cam follower connected to the stem and engaging the cam member proximally of the guide sheath, the cam member and cam follower being mutually configured to convert rotary motion of the output shaft to reciprocatory movement of the stem along said axis.

8. A mascara dispenser comprising an applicator as defined in claim 7 and a container of mascara having a neck engageable with said cap.

* * * * *